US006279371B1

(12) United States Patent
Brewer

(10) Patent No.: US 6,279,371 B1
(45) Date of Patent: Aug. 28, 2001

(54) HAND-HELD RIVETING TOOL

(76) Inventor: Robert Brewer, 5915 Tarammell Rd., Apt #Q8, Morrow, GA (US) 30260

( * ) Notice: Subject to any disclaimer, the term of this patent is extended or adjusted under 35 U.S.C. 154(b) by 0 days.

(21) Appl. No.: 09/557,452

(22) Filed: Apr. 24, 2000

(51) Int. Cl.[7] ..... B21J 15/40

(52) U.S. Cl. ..... 72/479; 72/437; 72/466.5; 72/466.9

(58) Field of Search ..... 72/479, 437, 466.4, 72/466.5, 466.9

(56) References Cited

U.S. PATENT DOCUMENTS

| | | | | |
|---|---|---|---|---|
| 974,677 | * | 11/1910 | Kirk | 72/479 |
| 2,321,225 | * | 6/1943 | McIntire | 72/479 |
| 2,328,391 | * | 8/1943 | Nelson | 72/479 |
| 2,353,559 | * | 7/1944 | Hajek, Jr. | 72/479 |
| 2,354,914 | * | 8/1944 | Golstein | 72/479 |
| 2,512,532 | * | 6/1950 | Sargent et al. | 72/479 |
| 2,519,308 | * | 8/1950 | Brown | 72/479 |
| 4,218,911 | * | 8/1980 | Johnson | 72/479 |

* cited by examiner

*Primary Examiner*—David Jones
(74) *Attorney, Agent, or Firm*—Clifford A. Poff

(57) ABSTRACT

A hand-held tool for forming a rivet head at the plain end of a rivet includes an elongated handle having an elongated internal cavity with a guide wall surface extending to an adjacent guide wall surface in an insert having an end wall. The end wall is provided with a predetermined thickness and contains an aperture to house a shop head formed on the plain head of a rivet. An inertia block is slidably guided by the guide wall surfaces of the handle and insert for reciprocation between a displaced position remote from the end wall and a position for contact with the end wall. A spring located in the elongated handle urges the inertia block against an end of a rivet when protruding from the aperture in the end wall and arrests recoiling movement of the inertia block after impact with a rivet end in a direction away from the end wall.

6 Claims, 3 Drawing Sheets

HAND-HELD RIVETING TOOL

CROSS-REFERENCE TO RELATED APPLICATIONS

Not applicable.

BACKGROUND OF THE INVENTION

1. Field of the Invention

The present invention relates to a hand-held tool for forming a rivet head on the plain end of a rivet used to join two or more plates or other structural members together and more particularly to such a hand-held tool embodying a construction and arrangement of parts for controlling the upsetting of rivet material to establish an effective load-bearing joint with the newly formed rivet head having a desired head dimension.

2. Description of the Prior Art

It is well known in the art to fasten two or more structural members togther by a riveted joint usually made up of one or more rows of rivets in a rivet pattern. The installation of a rivet requires hammering or otherwise upsetting the plain end of the rivet protruding from a rivet hole to form a rivet head which must tightly bear against the metal of the structural member surrounding the rivet hole. Power operated tools are used for impacting the preformed rivet head but a bucking bar of some sort is needed to form a shop head on the rivet. The present invention addresses a need for a readily controllable, hand-held tool to form a rivet head particularly in an operating environment of limited space otherwise prohibited to the use of automatic rivet machinery and power operated tools.

The hand-held tool of the present invention is particularly useful in the aircraft industry for cold riveting of aluminum or aluminum alloy rivets in locations generally not accessible to power operated tools. Additionally, the rivet head formed on the plain end of a rivet is controlled by the operation of the hand-held tool of the present invention can be used to ensure compliance with certain industrial standards in the aircraft industry that govern rivet adequacy. Under a visual inspection standard, the cold-worked rivet is examined to assess whether the end of the newly formed rivet head tightly bear against the metal surrounding the rivet hole and that the rivet head is uniformly thick. Under a more rigorous, or "zero tolerance" standard, the height and diameter of the newly formed rivet head are measured for compliance with an exact, "zero tolerance" head thickness and diameter standard. For example, a #5 rivet must have a head thickness which is one-half the diameter of the rivet shank diameter and a head diameter which are one and one-half the rivet shank diameter in order to satisfy the zero tolerance standard.

It is an object of the present invention to provide a versatile hand-held tool for forming a rivet head with a predetermined configuration on the plain end of a rivet.

It is a further object of the present invention to provide a hand-held tool for forming a rivet head compliant with rivet head standard of either the visual inspection standard or the zero tolerance standards.

It is another object of the present invention to provide a hand-held tool enabling a selection of parts suitable to establish a predetermined head thickness and selective to provide controlled or uncontrolled lateral spread of the deformed rivet material.

SUMMARY OF THE INVENTION

According to the present invention there is provided a hand-held tool for forming a rivet head at the plain end of a rivet, the hand-held tool including an elongated handle having an elongated internal cavity with a guide surface adjacent an end wall, the end wall having a predetermined thickness and containing an aperture to house a shop head when formed from the plain head of a rivet, an inertia block slidably guided by the internal guide surface for reciprocation between a displaced position remote from the end wall and a position for contact with the end wall, and a resilient member supported by the elongated handle for urging the inertia block against an end of a rivet when protruding from the aperture and arresting recoiling movement of the inertia block after impact with a rivet end in a direction away from the end wall.

BRIEF DESCRIPTION OF THE DRAWINGS

These features and advantages of the present invention as well as others will be more fully understood when the following description is read in light of the accompanying drawings in which.

DETAILED DESCRIPTION OF THE PREFERRED EMBODIMENTS

Figure 1:
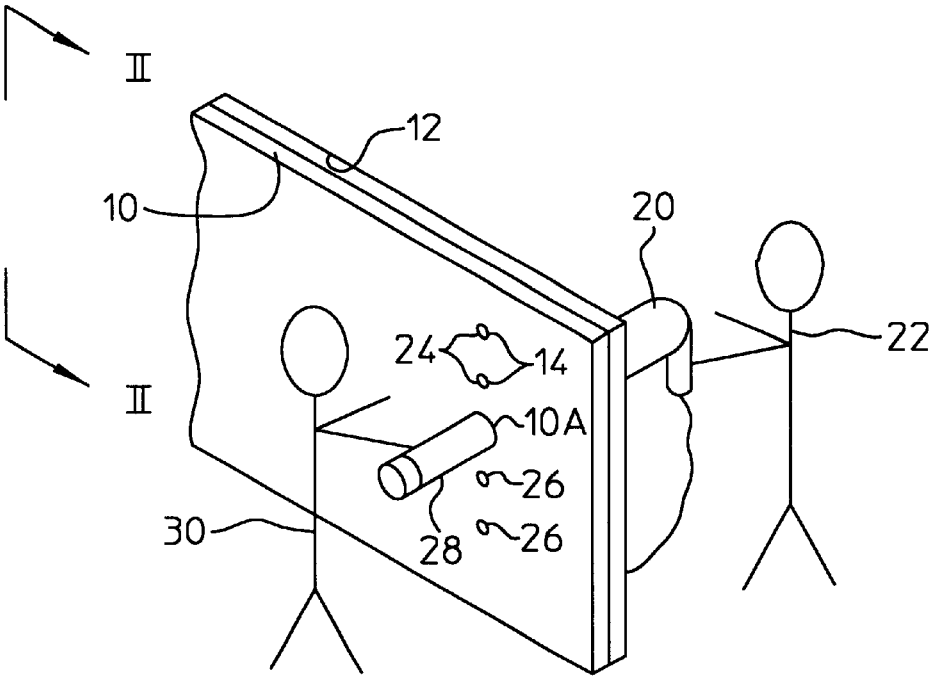
FIG. 1 is an isometric view of a riveting procedure using a hand-held riveting tool according to the present invention to form a rivet head on a plain end of a rivet.
Figure 2:
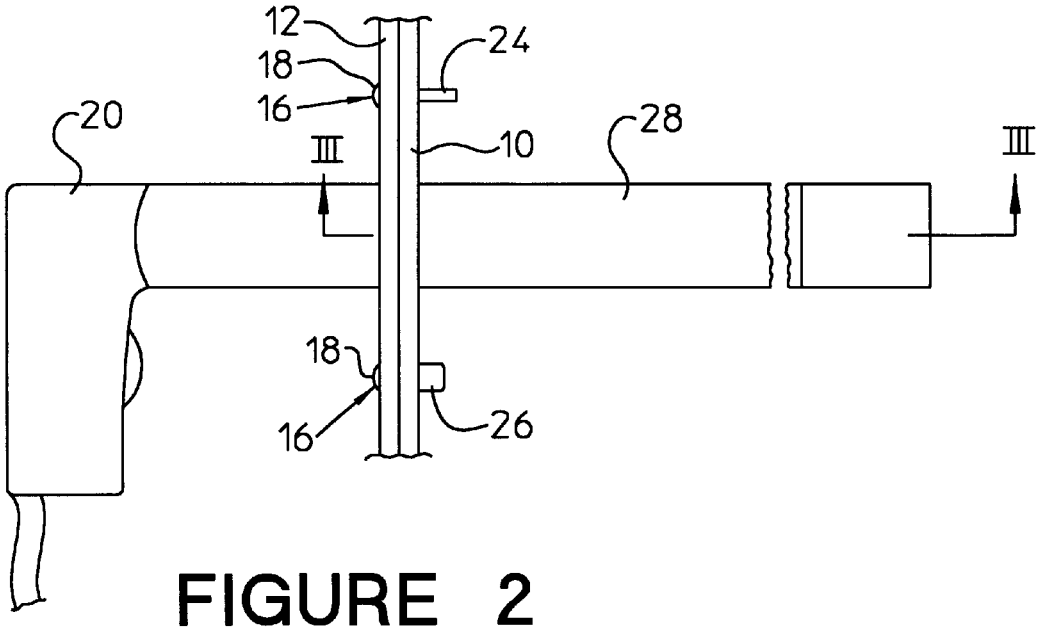
FIG. 2 is an enlarged end view taken along lines II—II of the FIG. 1.

In FIGS. 1 and 2 there are illustrated the end portions of two, sheet-like workpieces 10 and 12 placed in a face-to-face relationship with a row of aligned rivet holes 14 extending through the workpieces 10 and 12. A rivet 16 is introduced into each aligned rivet holes 14 such that a preformed rivet head 18 of each rivet is seated against a face of work piece 12 for contact by a hand-held impact riveting tool 20 operated by a first workman 22. The plain ends 24 of two upper rivets 16 are shown protruding from workpiece 10 and rivet heads 26 formed from the plain ends are shown on the two lower rivets. The rivet head 26 is sometimes called a shop head. A riveting tool 28 of the present invention is constructed for hand-held use and ease of manipulation by a second workman 30 for placing the tool in an operative position. In the operative position, an end face 10A of the tool is pressed tightly against the face surface of the workpiece 10 to enclose the protruding plain end of the rivet.

Figure 3:
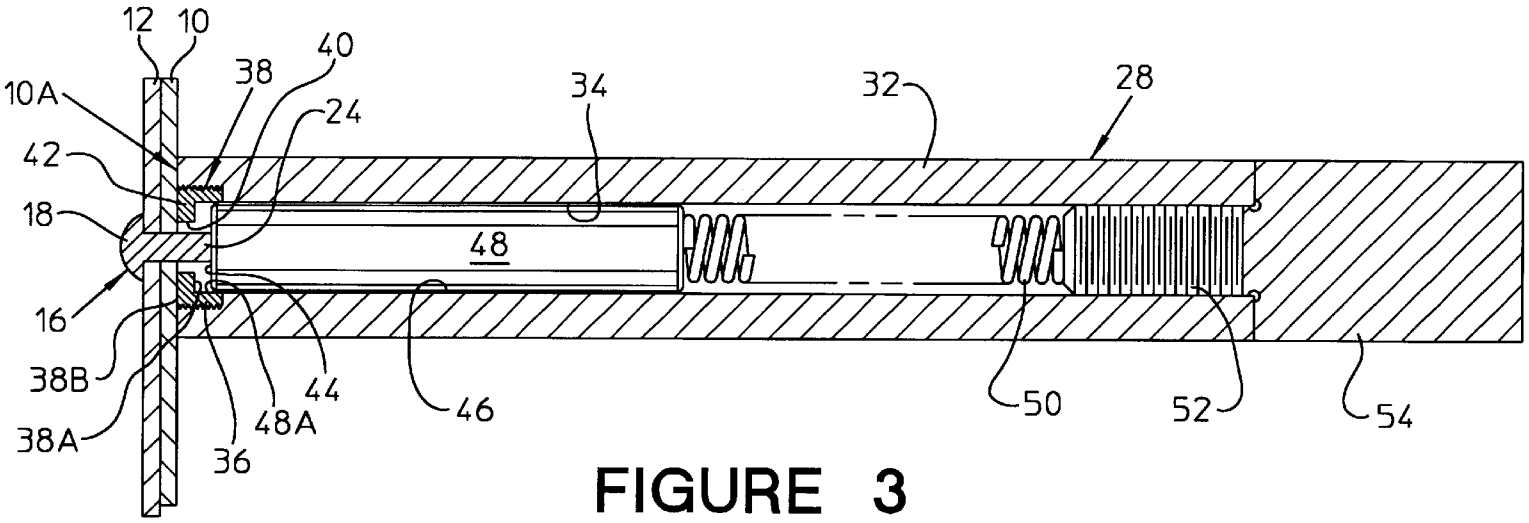
FIG. 3 is a sectional view taken along lines III—III of FIG. 2.

The details of the construction of the hand-held riveting tool 28 are illustrated in FIG. 3 and essentially include an elongated handle 32 having a cylindrical outer surface with a diameter and a length dimensioned sufficient to traverse the palm portion of a worker's hand to allow a workman to grasp and manipulate the handle 32 when placing the tool tightly against the face surface of the workpiece. The handle has a tubular construction formed by a continuous internal cavity 34 having a counterbored end portion formed with internal threads that threadedly engage with external threads formed on an upstanding side wall 36 of a replaceable cup-shaped insert 38. The insert 38 includes an annular aperture 40 centrally located in an uniformly thick end wall 42 having generally planar, parallel internal and external face surfaces 38A and 38B, respectively. The size of the aperture 40 in the uniformly thick end wall 42 define an aperture volume to house a shop head formed on a plain end of a rivet. The external wall surface 38B is coplanar with the terminal end surface of handle 32 for defining end face 10A.

The cup-shaped insert 38 is designed and intended to be replaced by a selected one of other cup-shaped inserts having differently dimensioned end wall thickness and aperture diameter for forming shop heads on plain end portions of a variety of differently sized rivets. The internal diameter of the upstanding side wall 36 cup-shaped insert 38 is constructed and dimensioned to form an internal annular guide surface 44 that is an extension of an internal guide surface 46 formed in cavity 34. The internal guide surfaces 44 and 46 function to slidably guide an elongated, cylindrically shaped inertia block 48 to reciprocate between a displaced position remote from the end wall 42 and a position where an end portion 48A of the inertia block contacts the internal face surface 38A of the end wall 42. A resilient member preferably taking the form of an elongated helical spring 50 resides in the cavity 34 having one end engaged with an end of the inertia block 48 which is opposite the end portion 48A. The cavity 34 is closed off by a threaded protrusion 52 engaged with internal threads in the end portion of the handle remote to the cup-shaped insert 38. The threaded protrusion 52 is part of a removable cap 54 to allow access to the internal cavity 34 for substitution of spring 50 with an other spring having different elastic properties chosen on the basis of a predetermined shop head volume and the size of the aperture in the end wall needed to house the shop head.

The load capacity of spring 50 and the mass of inertia block 48 relative to the aggregate of the mass of the handle 32, cup-shaped insert 38 and removable cap 54 are important factors for assuring that the handle remains effective for upsetting the plain end of a rivet. In this regard, when the end face 10A of the tool of the present invention is placed tightly against a workpiece, an impact force applied to a rivet produces an upsetting of the plain end of the rivet as an incident to transferring energy to the inertia block 48 which causes displacement of the inertia block thus compressing the spring 50 until the recoiling movement of the inertia block is arrested by the force of spring 50. A further instance of upsetting the plain end of the rivet occurs upon arresting of recoiling movement of the inertia block upon engagement with the plain end of a rivet. This movement of the inertia block is continued until the plain end of the rivet no longer protrudes from the aperture 40.

Figure 4:
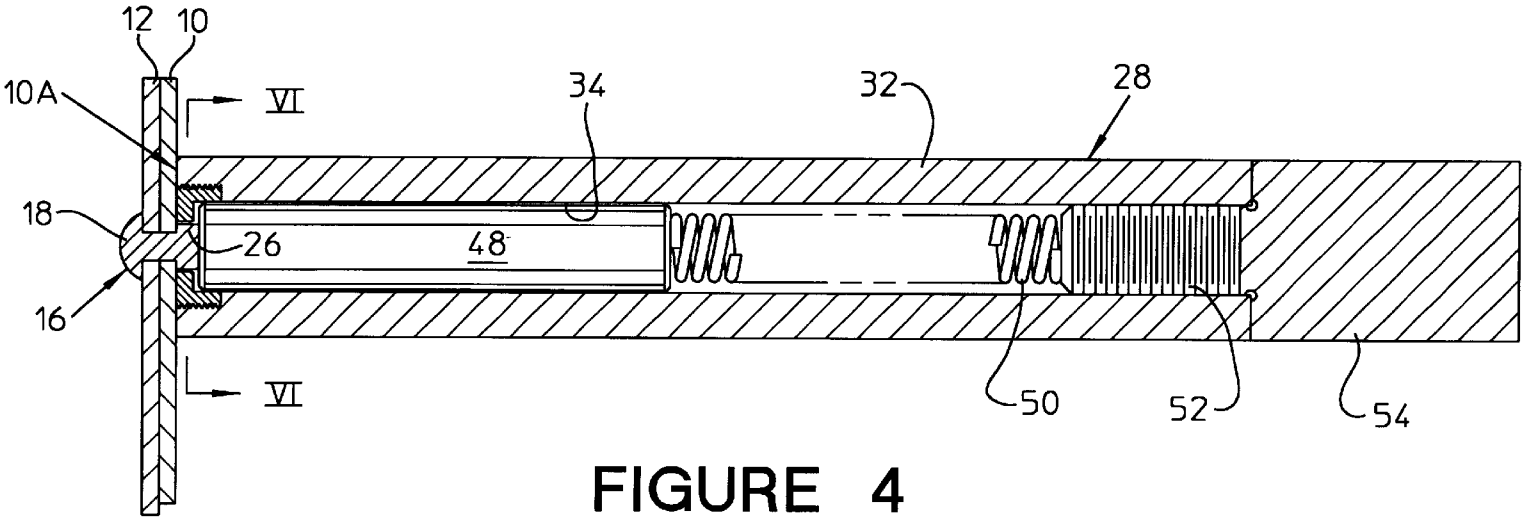
FIG. 4 is a perspective view illustrating the arrangement of a rivet after completion of the installation process using the riveting tool of the present invention.
Figure 6:
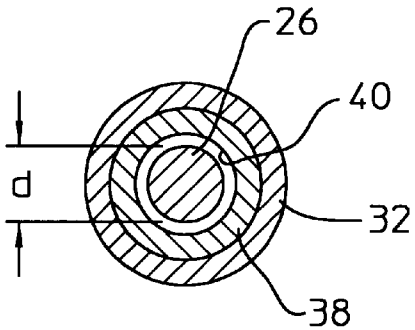
FIG. 6 is a sectional view taken along lines VI—VI of FIG. 4.
Figure 5:
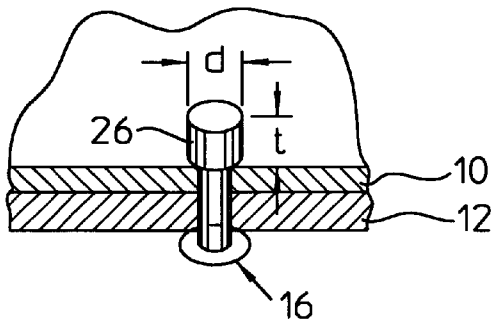
FIG. 5 is a partial sectional view of the riveting tool shown in FIG. 3 and illustrating the arrangement of parts according to one embodiment for the formation of a rivet head for a visual inspection standard.

The configuration of rivet 16 following installation in workpieces 10 and 12 is shown in FIG. 4 for joining together the workpieces 10 and 12 between the preformed rivet head 18 and the rivet head 26 formed on the plain end of the rivet. The rivet head 26 occupies a volume defined by the head thickness "t" and head diameter "d" which volume is encompassed by the aperture 40. In FIGS. 5 and 6, the thickness "t" is established by the predetermined thickness of the end wall 42. The diameter "d" is a function of the volume of rivet material upset by the use of the riveting tool of the present invention. In this embodiment of the cup-shaped insert 38, the diameter of the annular central aperture 40 exceeds the head diameter "d" of the rivet and results in the formation of an annular gap 60 having the form of a circular ring between the rivet head and the aperture 40. This construction of parts for forming the rivet head is best suited for visual inspection standard for determining that the cold worked shop head rivet tightly bears against the metal surrounding the rivet hole and that the shop head is uniformly thick.

Figure 7:
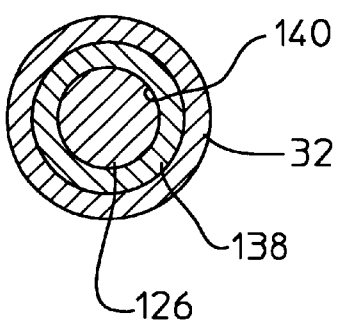
FIG. 7 is a view similar to FIG. 6 and illustrating a second embodiment with an alternative relationship of a rivet head in a zero tolerance rivet head chamber.

FIG. 7 illustrates an embodiment of the present invention in which a substitute cup-shaped insert 138 constructed in the same manner as cup-shaped insert 38 but provided with a central annular aperture 140 which defines with the thickness of the end wall of the insert 138, a volume for the shop head 126 for carrying out a "zero tolerance" standard for cold working of the plain end of a rivet. In this embodiment, the annular side wall of the shop head 126 is in a metal-to-metal engagement with the annular sidewall of the central annular aperture 140.

While the present invention has been described in connection with the preferred embodiments of the various figures, it is to be understood that other similar embodiments may be used or modifications and additions may be made to the described embodiment for performing the same function of the present invention without deviating therefrom. Therefore, the present invention should not be limited to any single embodiment, but rather construed in breadth and scope in accordance with the recitation of the appended claims.

I claim:

1. A hand-held tool for forming a shop head on a plain end of a rivet, said hand-held tool including:

an elongated handle having an elongated continuous internal cavity terminating at internal threaded end portions with a guide surface adjacent an end wall defined by a cup shaped insert with an upstanding threaded side wall engaged with one of said internal threaded end portions, said threaded side wall terminating at a planar wall which is coplanar with a terminal end of said elongated handle, said end wall having a predetermined thickness to establish a predetermined shop head thickness and containing an aperture having a predetermined diameter to house a volume of rivet material upset to form a shop head;

an inertia block slidably guided by said internal guide surface for reciprocation between a displaced position remote from said end wall and a position for contact with said end wall; and a resilient member supported by said elongated handle for urging said inertia block against an end of a rivet when protruding from said aperture and arresting recoiling movement of said inertia block after impact with a rivet end in a direction away from said end wall.

2. The tool according to claim 1 wherein said upstanding threaded side wall includes an internal annular guide for forming a continuation of said internal guide surface of said elongated handle for receiving said inertia block.

3. The tool according to claim 1 wherein said end wall includes substantially parallel planar internal and external wall surfaces when supported by said elongated handle.

4. The tool according to claim 1 wherein said predetermined thickness of said end wall and said predetermined diameter of said aperture defines a volume for a shop head without a clearance in said predetermined aperture.

5. The tool according to claim 1 wherein said predetermined thickness of said end wall and said predetermined diameter of said aperture defines a volume for a shop head with a clearance in said predetermined aperture.

6. A hand-held tool for forming a shop head on a plain end of a rivet, said hand-held tool including:

an elongated handle having a continuous internal cavity closed at one end by an end wall and by a cap at the end opposite thereto, said internal cavity having a guide surface adjacent said end wall, said end wall having a predetermined thickness and containing an aperture to house a shop head when formed from a plain end of a rivet, said elongated handle including internal threaded end portions each terminating an end of said continuous internal cavity, said end wall comprising a cup shaped insert having a threaded surface for mating engagement with one of said threaded end portions, and wherein said cap is further defined by a threaded plug portion extending from a handle extension for threaded engagement with the other of said threaded end portions;

an inertia block slidably guided by said internal guide surface for reciprocation between a displaced position remote from said end wall and a position for contact with said end wall; and a spring located in said internal cavity between said inertia block and said cap for urging said inertia block against an end of a rivet when protruding from said aperture and arresting recoiling movement of said inertia block after impact with a rivet end in a direction away from said end wall.

* * * * *